US007114544B2

(12) United States Patent
Rice et al.

(10) Patent No.: US 7,114,544 B2
(45) Date of Patent: Oct. 3, 2006

(54) CORD TENSIONER FOR COVERING FOR ARCHITECTURAL OPENINGS

(75) Inventors: Chris A. Rice, Boca Raton, FL (US); Robert L. Eggleston, Marathon, FL (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 25 days.

(21) Appl. No.: 10/936,408

(22) Filed: Sep. 7, 2004

(65) Prior Publication Data

US 2006/0048907 A1 Mar. 9, 2006

(51) Int. Cl.
*E06B 9/382* (2006.01)

(52) U.S. Cl. ..... 160/178.1 V; 160/322

(58) Field of Classification Search ..... 160/321, 160/178.1 V, 320, 322, 344, 345; 16/219; 267/71

See application file for complete search history.

(56) References Cited

U.S. PATENT DOCUMENTS

| | | | | | |
|---|---|---|---|---|---|
| 950,952 | A | | 3/1910 | Perrott | |
| 2,830,808 | A | * | 4/1958 | Graber | 267/71 |
| 3,112,103 | A | * | 11/1963 | Falkenberg | 267/71 |
| 3,151,857 | A | * | 10/1964 | Falkenberg | 267/71 |
| 3,294,153 | A | | 12/1966 | Fountain | 160/168 |
| 3,590,900 | A | * | 7/1971 | Salzmann | 160/126 |
| 3,633,646 | A | | 1/1972 | Zilver | 160/168 |
| 3,945,264 | A | * | 3/1976 | Falkenberg | 474/138 |
| 4,473,101 | A | | 9/1984 | Langeler | |
| 4,557,309 | A | | 12/1985 | Judkins | 160/84 R |
| 4,601,131 | A | | 7/1986 | Ozols | |
| 4,732,202 | A | | 3/1988 | Anderson | |
| 4,733,711 | A | | 3/1988 | Schon | 160/84.1 |
| 4,811,466 | A | | 3/1989 | Zubli | 24/115 G |
| 4,825,929 | A | | 5/1989 | Haines | |
| 5,168,913 | A | | 12/1992 | Haines | 160/168.1 |
| 5,275,222 | A | | 1/1994 | Jelic et al. | 160/178.2 |
| D377,287 | S | | 1/1997 | Biba | D6/581 |
| 5,752,558 | A | * | 5/1998 | Lin | 160/320 |
| D395,973 | S | | 7/1998 | Huang | D6/581 |
| 5,845,696 | A | * | 12/1998 | Chou | 160/178.1 V |
| 5,904,198 | A | | 5/1999 | Huang | 160/168.1 R |
| D428,292 | S | | 7/2000 | Anderson | D65/581 |
| 6,098,970 | A | | 8/2000 | Lowe | 267/179 |

(Continued)

FOREIGN PATENT DOCUMENTS

| | | |
|---|---|---|
| EP | 0 699 268 | 1/1997 |

(Continued)

*Primary Examiner*—David Purol
(74) *Attorney, Agent, or Firm*—Dorsey & Whitney LLP

(57) ABSTRACT

A tensioner for the control element of a covering for an architectural opening includes a base member attachable to a support surface adjacent to the architectural opening with the base member supporting an upstanding plunger about which a surrounding housing is adapted to slide. A coil spring biases the housing downwardly relative to the plunger and a rotatable pulley is mounted in an open top of the housing around which an endless operating element for a covering for an architectural opening extends. Operation of the covering by pulling on the endless element raises the housing relative to the plunger permitting free rotation of the pulley. Upon completion of operation the housing lowers under the bias of the coil spring so that the pulley is seated in engagement with the plunger and restrained from rotation. The angular spacial orientation of the pulley can also be changed by raising the housing relative to the plunger a predetermined distance and rotating the housing into a desired angular spacial orientation relative to the plunger.

12 Claims, 6 Drawing Sheets

U.S. PATENT DOCUMENTS

| | | | | |
|---|---|---|---|---|
| 6,792,999 | B1 * | 9/2004 | Cross et al. | 160/321 |
| 2004/0159410 | A1 | 8/2004 | Welfonder | |
| 2005/0101456 | A1 | 5/2005 | Franssen | |

FOREIGN PATENT DOCUMENTS

| | | | |
|---|---|---|---|
| EP | 1 447 516 | A2 | 8/2004 |
| GB | 381894 | | 10/1932 |
| GB | 2 050 560 | A | 1/1981 |
| JP | 60-88779 | | 5/1985 |
| WO | WO 94/28279 | A1 | 12/1994 |
| WO | WO 99/55553 | | 11/1999 |

* cited by examiner

CORD TENSIONER FOR COVERING FOR ARCHITECTURAL OPENINGS

BACKGROUND OF THE INVENTION

1. Field of the Invention

This invention relates generally to coverings for architectural openings and more particularly to a cord tensioner for mounting in an architectural opening and for securing the lower extent of an endless operating element or cord used to operate the covering.

2. Description of the Relevant Art

Coverings for architectural openings have taken numerous forms through the many years they have been used for covering windows, doors, archways, or the like. Early forms of such coverings consisted simply of fabric materials draped across an architectural opening while more recent forms of covering have included retractable coverings such as venetian blinds, vertical blinds, cellular shades, and the like.

Retractable coverings are typically operated with a control cord that is operatively connected to a control system in a headrail for the covering with control cords assuming several different variations. A single cord can depend from one end of the headrail and can be moved up and down to operate the covering and move it between open and closed conditions and/or between retracted and extended conditions. A pair of control cords can also depend from the headrail in a similar manner again for manipulating the covering between different conditions.

Some coverings for architectural openings are operated with an endless flexible element such as a cord, tape, or chain that cooperates with a control system in the headrail for operating the covering and hangs from a headrail in an endless loop so that one run of the depending endless loop can be pulled downwardly while the other run moves upwardly to operate the covering. It has been found desirable with endless operating elements that securing or anchoring the lower extent of the endless element adjacent the bottom of the architectural opening makes the covering easier to operate and is aesthetically more attractive as there are no dangling elements but rather suitably tensioned elements confined between the headrail and an anchor at the bottom of the architectural opening. Anchors at the bottom of the architectural opening are sometimes referred to as tensioners as they typically have resilient means for biasing the endless control element into a desirably taut condition.

It is to provide improvements in tensioners for endless operating elements for coverings for architectural openings that the present invention has been developed.

BRIEF SUMMARY OF THE INVENTION

The present invention concerns a tensioner for securing the lower extent of an endless control element used in coverings for architectural openings such as coverings for windows, doors, archways, and the like. The tensioner is adapted to be secured to a structural element adjacent the bottom of an architectural opening and includes a pulley around which the lower extent of the endless control element extends. The pulley is rotatably mounted in a housing slidably connected to a plunger that projects upwardly from an anchored location adjacent the bottom of the architectural opening. A coil spring is provided within the housing and is in operative relationship with the plunger so that the housing can be raised from a neutral position against the bias of the spring when operating the covering. The plunger cooperates with a passage through the housing to releasably fix the housing relative to the plunger in any one of four angularly related positions. The plunger is also designed to grip the endless element when the housing is in the neutral position to prevent inadvertent opening, closing, extension, or retraction of the covering.

Other aspects, features, and details of the present invention can be more completely understood by reference to the following detailed description of a preferred embodiment, taken in conjunction with the drawings and from the appended claims.

DETAILED DESCRIPTION OF THE INVENTION

Figure 1:
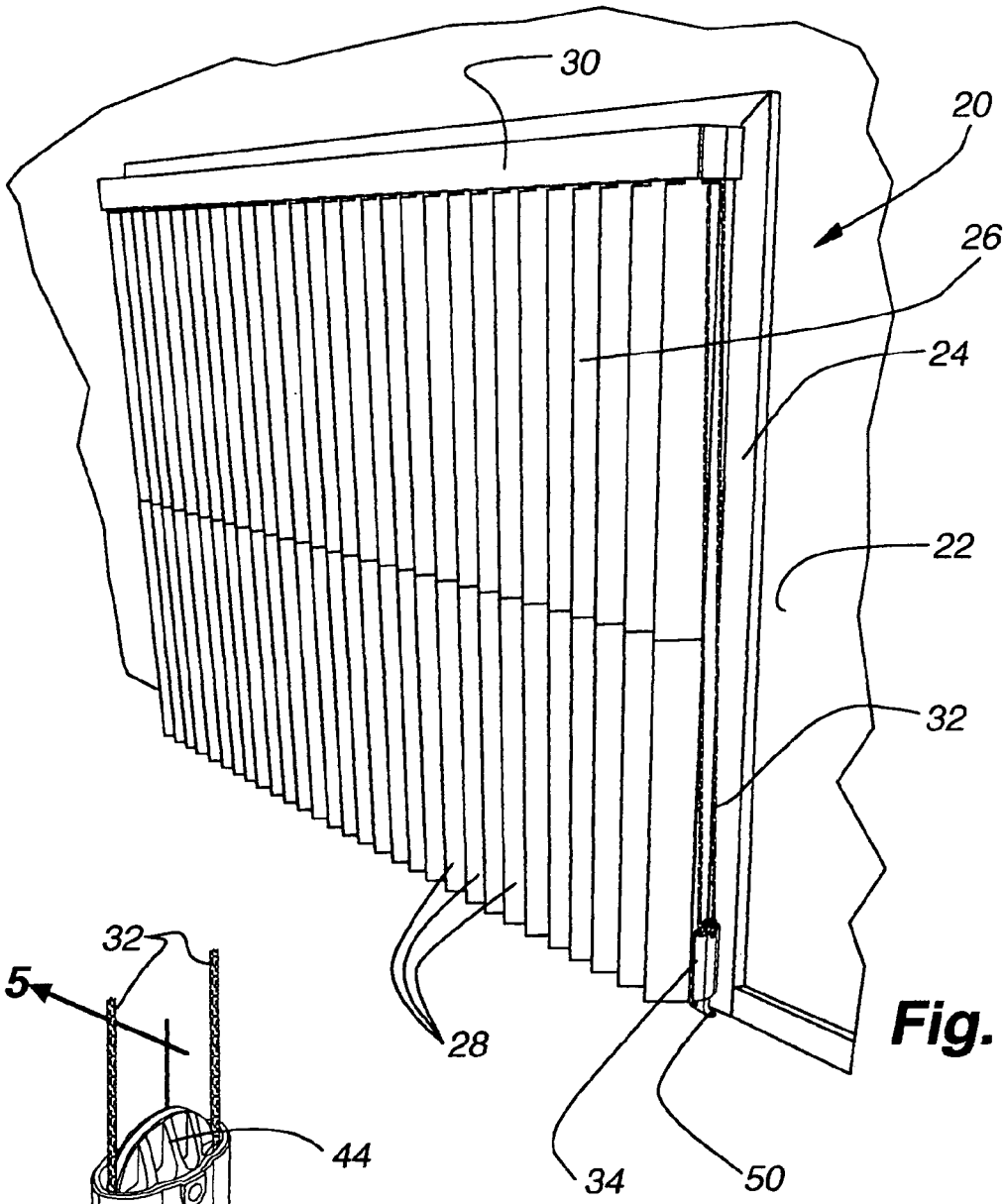
FIG. 1 is a fragmentary isometric of a wall in a building structure having an architectural opening with a covering incorporating the present invention mounted therein.

Referring first to FIG. 1, an architectural opening 20 is disposed in a wall 22 of a building structure with the opening having a framework 24 therearound and a covering 26 for the architectural opening mounted thereacross. The covering illustrated is a vertical vane covering having a plurality of vertically suspended vanes 28 hanging from carriers (not seen) within a headrail 30 for the covering. A control element in the form of an endless loop cord 32 is suspended from one end of the headrail and in a conventional manner is in operative engagement with control components for the covering disposed and hidden within the headrail. Movement of the control element in one circulating direction causes the vanes to extend across the architectural opening while circulating movement of the control element in the opposite direction causes the vanes to be retracted adjacent to one side of the opening. The lower extent of the endless control element is anchored in the cord tensioner 34 of the present invention as will be described in more detail hereafter so that the control element has an effective length defined between the headrail and the cord tensioner. It should be understood that while the tensioner is described in connection with a vertical vane covering, the tensioner could be used with any type of covering for architectural openings wherein an endless element is used for operating the covering. Further, while the tensioner will be described in detail in connection with an endless cord-type element for operating the covering, the element would not necessarily have to be a cord but could be a tape, for example, a beaded chain, or other known flexible element of a substantially non-extensible nature utilized in the operation of coverings for architectural openings. Further, while the tensioner 34 will be described as being positioned adjacent to the bottom of an architectural opening so as to operatively engage the lower extent of an endless operating element, the tensioner could be positioned at other locations such as at the top of the opening, for example, or adjacent either side depending on the type and special orientation of the covering.

Figure 2:
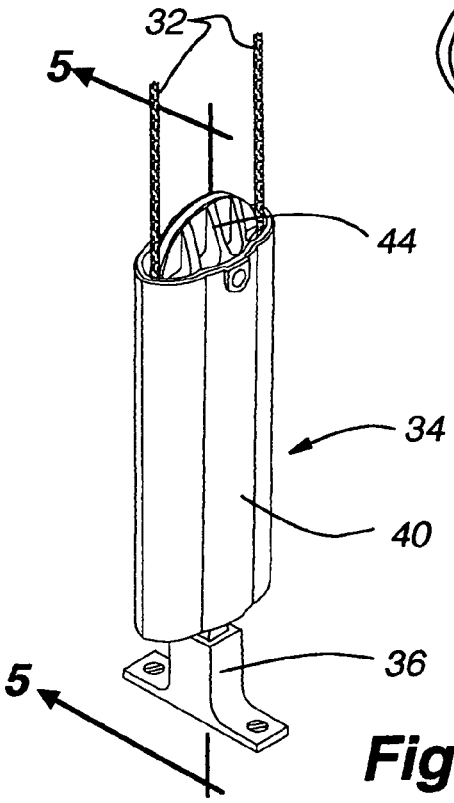
FIG. 2 is a fragmentary isometric of the tensioner of the present invention in operative engagement with a control cord.
Figure 3:
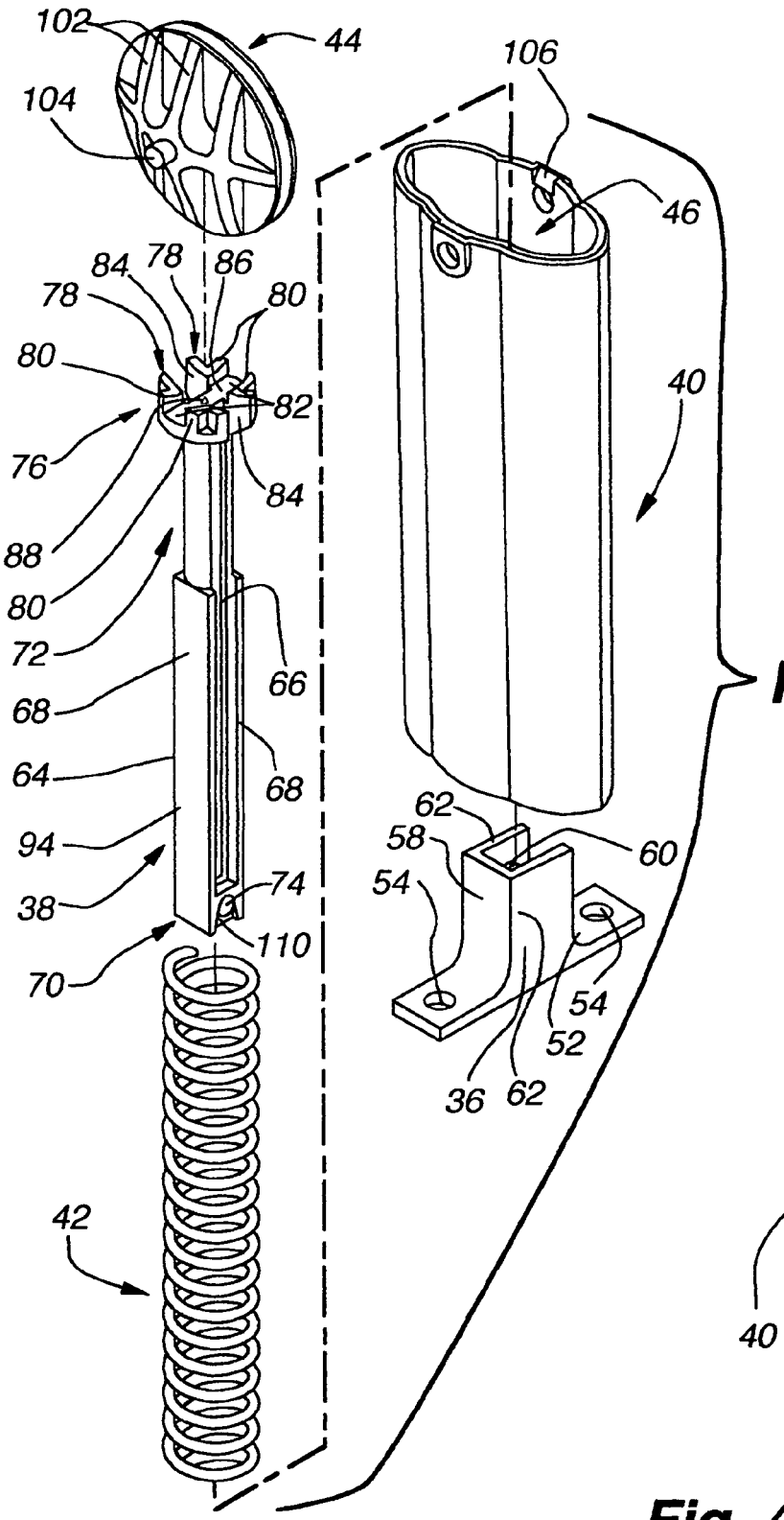
FIG. 3 is an enlarged exploded isometric of the tensioner shown in FIG. 2.
Figure 4:
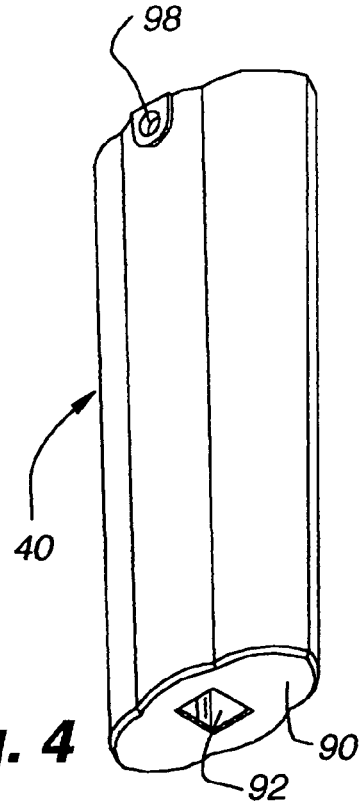
FIG. 4 is an isometric looking upwardly toward the bottom of the housing of the tensioner of FIG. 2.

As probably best appreciated by reference to FIG. 3, the tensioner 34 of the present invention includes a mounting base 36 to which a plunger 38 is pivotally mounted, a housing 40 surrounding and in slidable operative relationship with the plunger, a coil spring 42 surrounding the plunger and biasing the plunger and housing into a neutral at rest retracted position, and a pulley 44 rotatably mounted in an open end 46 of the housing and around which a flexible control element 32 extends. The components of the tensioner 34 are operatively interconnected such that the plunger 38 can guide vertical reciprocal movement of the housing 40 while the housing rotatably supports the pulley 44 which permits circulating movement of the control element 32 during operation of the covering for the architectural opening. The plunger, while being pivotally connected to the base for pivotal movement about a horizontal axis, is fixed relative to a support surface 50 adjacent to the architectural opening 20 and the coil spring 42 biases the housing into a lowered retracted or neutral position (FIG. 2) relative to the plunger. The coil spring yieldingly resists upward vertical sliding movement of the housing relative to the plunger but does in fact permit such movement. Upward movement of the housing is created when the operating element 32 is pulled to some degree laterally so as to shorten its effective overall vertical extent. A lateral force on the control element therefore raises the pulley which is rotatably mounted in the housing to accommodate the shortened effective vertical extent of the control element or cord. As will be described in more detail later, such vertical movement of the pulley relative to the plunger releases a locking relationship between the pulley and the plunger to facilitate operation of the covering.

Figure 5:
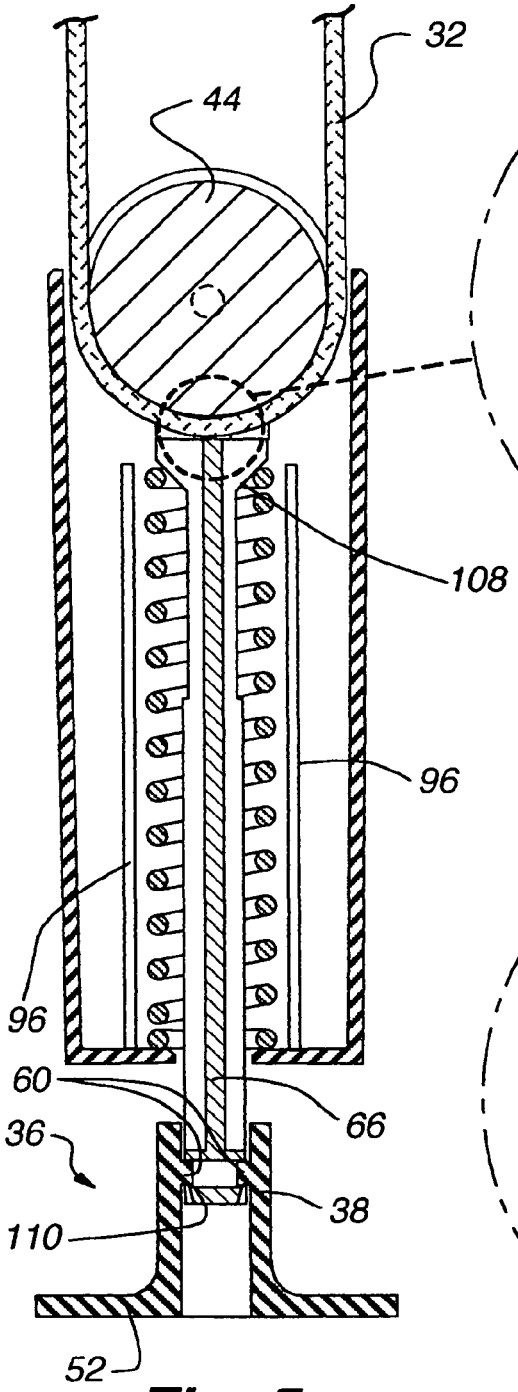
FIG. 5 is an enlarged fragmentary section taken along line 5—5 of FIG. 2.
Figure 6:
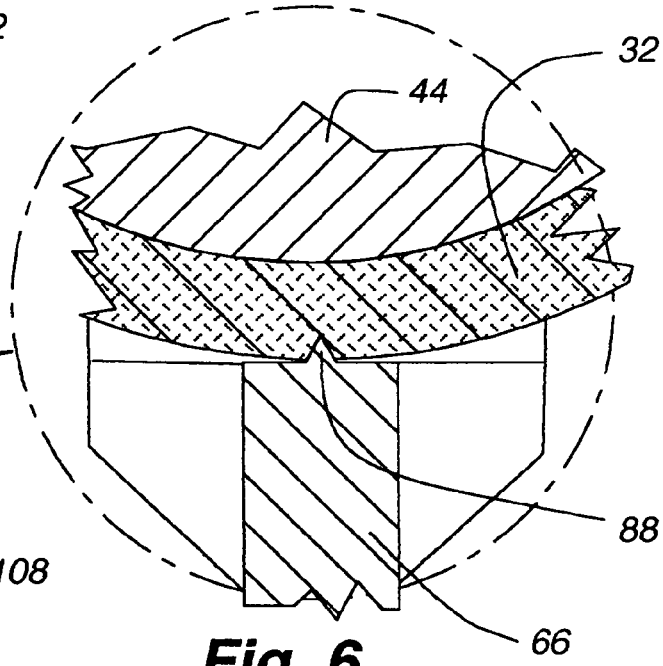
FIG. 6 is an enlarged fragmentary section illustrating the portion of FIG. 5 encircled in dashed lines.
Figure 7:
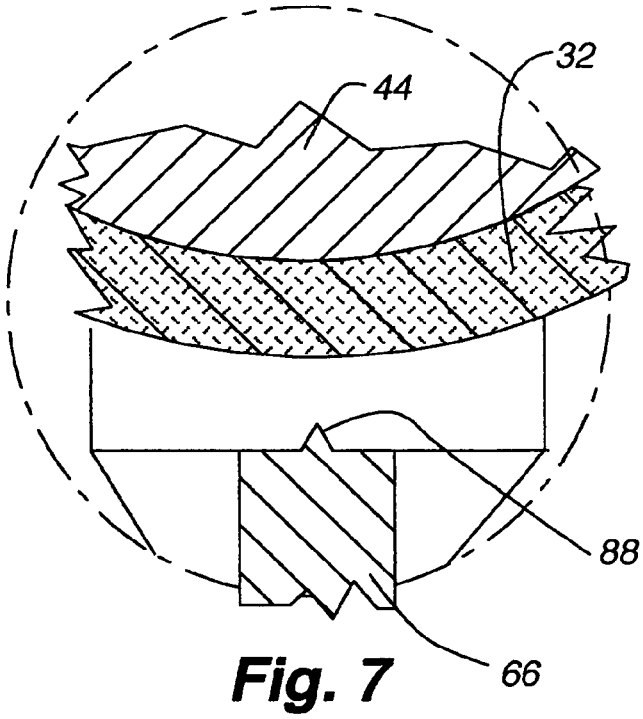
FIG. 7 is a section similar to FIG. 6 with the pulley and plunger of the tensioner in a disengaged position.

The mounting base 36 is probably best seen in FIGS. 3 and 5 to include a flat base plate 52 having a pair of apertures 54 therethrough for the receipt of fasteners 56 (FIGS. 14 and 15) to anchor the base to the support surface 50 adjacent to the architectural opening and an upstanding pedestal 58 of generally U-shaped cross section. The pedestal has a pair of opposed stub shafts 60 protruding inwardly from side walls 62 and is made of a somewhat rigid material such as plastic that has some flexibility and resiliency.

The plunger 38, as probably best seen in FIG. 3, has a relatively thin elongated body or shaft 64 of generally I-beam shaped construction so as to define an elongated vertical plate 66 with perpendicular vertical flanges 68 along opposite edges. The flanges 68 are of a first width from the base 70 of the plunger to a location approximately two-thirds along its length at which point they are reduced in width to define an upper relatively thin portion 72 of the plunger which remains of I-beam shaped construction. At the base or lower end of the plunger, it is of block-like construction having a transverse passage 74 therethrough. The passage through the block is adapted to receive the stub shafts 60 on the anchor or mounting base 36 so that the plunger 38 is free to pivot within the base but only through a 90-degree arc. At the opposite or upper end of the plunger is an enlarged head 76 defining multiple seats for the pulley 44 as will be described in more detail later. The head is bifurcated so as to have identical half-portions 78, each aligned with a flange 68 of the main body or shaft of the plunger. Each half-portion 78 of the head has a pair of upstanding spaced fingers 80 of generally V-shaped transverse cross section. The fingers on each half-portion of the head are spaced to define a slot 82 therebetween and the spacing between the half-portions 78 is approximately the same as the spacing between the fingers and also defines a slot 84 therebetween. The slot 84 between the half-portions has a bottom wall or bridge 86 which is flat and has an upstanding barb 88 centered therein so that the barb is centrally aligned with both slots 82 and 84 in that the slots themselves are perpendicular and cross each other at the barb. Each slot defines an alternate seat in which the pulley 44 can rest in the neutral position of the tensioner as will become more clear later.

The housing 40 is hollow and of generally ovular transverse cross section having the open top end 46 and a bottom wall 90 across the opposite or bottom end. The bottom wall has a centrally located hole 92 of square transverse cross section extending therethrough with the dimensions of the square hole being slightly larger than the dimensions of the lower or larger portion 94 of the main body shaft of the plunger 38 so that the plunger is free to slide in the hole 92 but is prohibited from rotating in the hole when the lower or larger portion 94 of the shaft is horizontally aligned with the bottom wall of the housing. Further, for a purpose to be described later, while the square hole 92 through the bottom wall of the housing prohibits pivotal movement of the housing 40 relative to the plunger 38 when the bottom wall is horizontally aligned with the relatively large lower portion of the main body shaft of the plunger, the upper portion 72 of the main body shaft of the plunger is of a small enough dimension so that it will pivot or rotate within the square hole 92 through the bottom wall. This relationship between the plunger and the housing is important as will be described in more detail hereafter.

Figure 10:
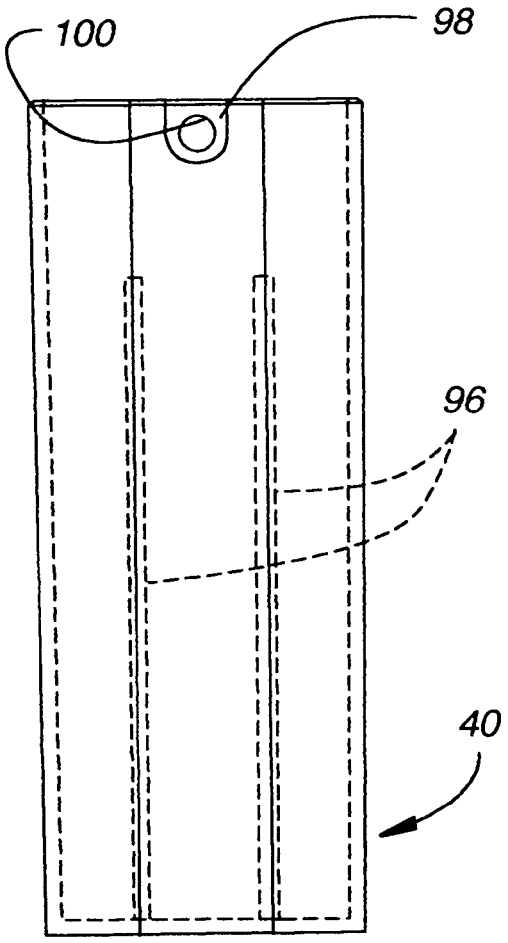
FIG. 10 is a front elevation of the housing component of the tensioner.
Figure 11:
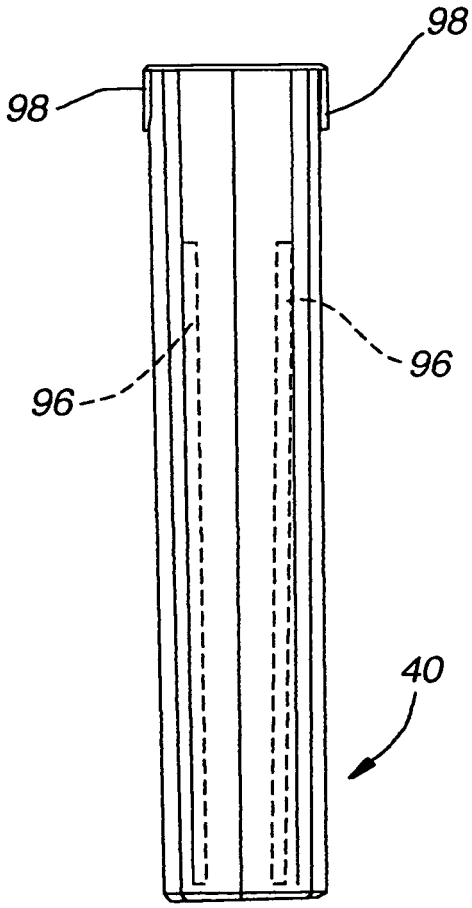
FIG. 11 is a side elevation of the housing of the tensioner.

As possibly best seen in FIGS. 5, 10, and 11, the housing 40 has four arcuately displaced inwardly and longitudinally extending ribs 96 which project upwardly from the bottom wall 90 of the housing to a location approximately three-fourths of the way along the length of the housing. The ribs project radially inwardly a distance so that in combination they define a space therebetween that is large enough to receive the shaft of the plunger as well as the coil spring 42 as will be described hereafter. At the top of the housing adjacent to the open end 46 thereof, a pair of bosses 98 are provided on opposite sides of the minor axis of the open end 46 with each boss having an axially aligned passage 100.

The pulley 44 in the preferred embodiment of the invention is a circular disk-type pulley having reinforcing ribs 102 on opposite faces and a pair of oppositely protruding stub shafts 104. The stub shafts are adapted to be rotatably received in the opposed passages 100 in the bosses at the top end of the housing for rotative support of the pulley in the housing. It should also be appreciated that the bosses at the top end of the housing have cam surfaces 106 adjacent thereto so that the stub shafts on the pulley can be forced downwardly and, through the cam action, force the walls of the housing, which is also made of a somewhat rigid but slightly flexible plastic, to flex outwardly to allow the stub shafts to be received in the axially aligned passages.

The coil spring 42 is a conventional coil spring having an inner diameter adequate to slidably receive even the larger lower portion 94 of the shaft of the plunger 38 and an outside diameter adapted to fit within the space defined between the ribs 96 in the interior of the housing 40. The ribs in the housing are closely enough spaced from the outer diameter of the spring, however, so that they retain the spring and consequently the plunger 38 in a centered position within the housing. The outer diameter of the spring is smaller than the cross-sectional dimension of the head 76 on the plunger and the lower surface 108 of the head on the plunger is beveled downwardly and inwardly so as to define a seat for the upper end of the spring. The lower end of the spring is adapted to rest on the bottom wall 90 of the housing in surrounding relationship with the square hole 92 therethrough. Of course, the spring is mounted on the plunger before the plunger is pivotally connected to the base 36 so that the spring is thereafter confined to a surrounding relationship with the main body shaft of the plunger.

Figure 8:
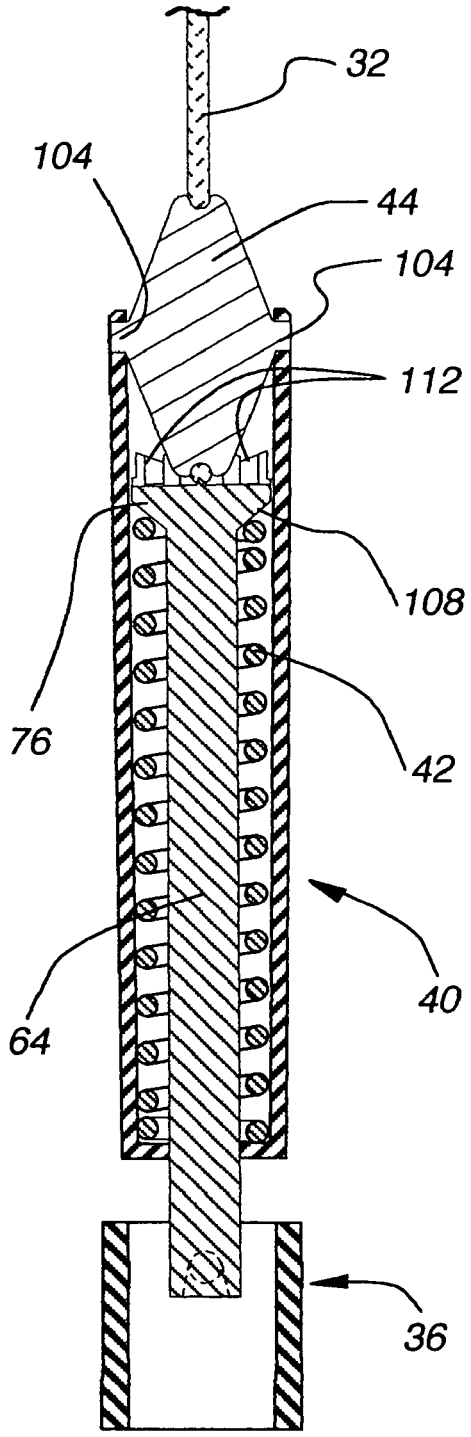
FIG. 8 is a vertical section taken through the tensioner of FIG. 2 showing the plunger and pulley in engaged relationship.
Figure 9:
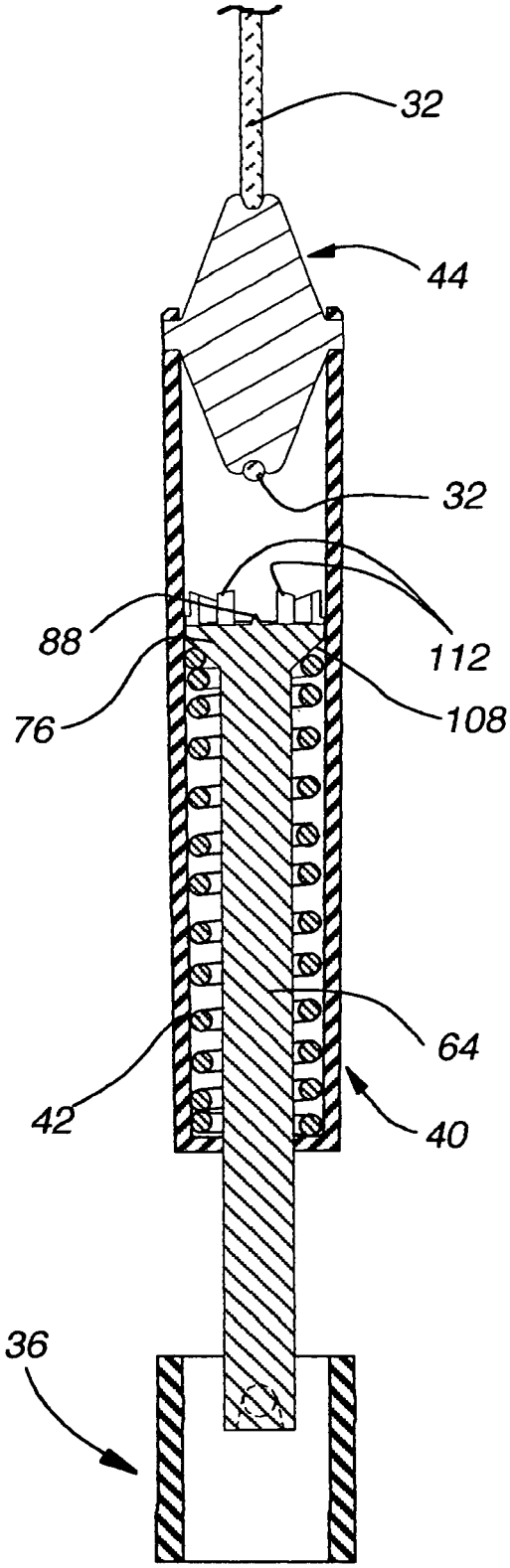
FIG. 9 is a vertical section similar to FIG. 8 with the plunger and pulley in a disengaged relationship.
Figure 12:
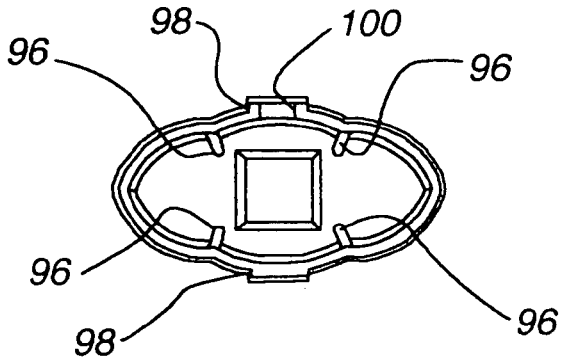
FIG. 12 is a top plan view of the housing of the tensioner.
Figure 13:
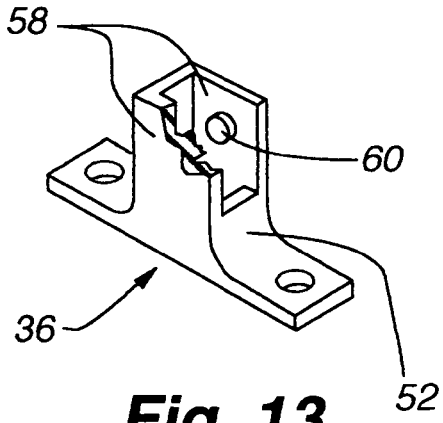
FIG. 13 is an isometric view with parts removed for clarity showing the mounting base of the tensioner.

Reference to FIGS. 8 and 9 illustrates the assembled relationship of the component parts of the cord tensioner 34 where it will be appreciated that the lower end of the plunger 38 is pivotally connected to the anchor base 36 on the stub shafts 60 and it can also be appreciated that the lower end of the shaft of the plunger at the boxed end thereof has inwardly tapered walls 110 below the passage 74 through the plunger which serve as cam surfaces in forcing the walls of the anchor base to flex outwardly in order that the stub shafts on the anchor base can be received in the passage in the plunger. The main body shaft of the plunger 38 extends upwardly into the housing along with the surrounding coil spring 42 and slides freely through the square hole 92 through the bottom wall 90 of the housing. When the tensioner is in its neutral at-rest condition, as shown in FIG. 8, the housing is completely lowered relative to the plunger so the pulley 44 is seated in one of the perpendicularly related slots 82 or 84 formed in the head 76. The slots in the head of the plunger and the somewhat mating relationship of the cross section of the lower portion of the plunger shaft with the square hole 92 through the bottom wall of the housing prevent pivotal movement of the housing about the longitudinal axis of the plunger. It should also be appreciated that in the neutral at-rest seated condition of FIG. 8, the upstanding barb 88 in the head is aligned with the control cord 32 as it passes around the bottom of the pulley so that the barb becomes embedded in the cord thereby preventing movement of the cord when the tensioner is in the neutral at-rest position.

When the housing 40 is raised relative to the plunger 38 against the bias of the coil spring 42, however, as shown in FIG. 9, the pulley 44 is unseated from the head 76 of the plunger thereby allowing it to rotate freely about its stub shafts 104 so that the control cord or element 32 can be circulated to operate the covering for the architectural opening. The housing will actually automatically lift relative to the plunger shortening the effective length of the control element when any lateral force is applied to the cord as such a lateral force which is typical when pulling or circulating the pull cord, will cause the effective overall vertical extent of the cord to shorten which is accommodated by sliding movement of the housing upwardly against the bias of the coil spring.

Figure 14:
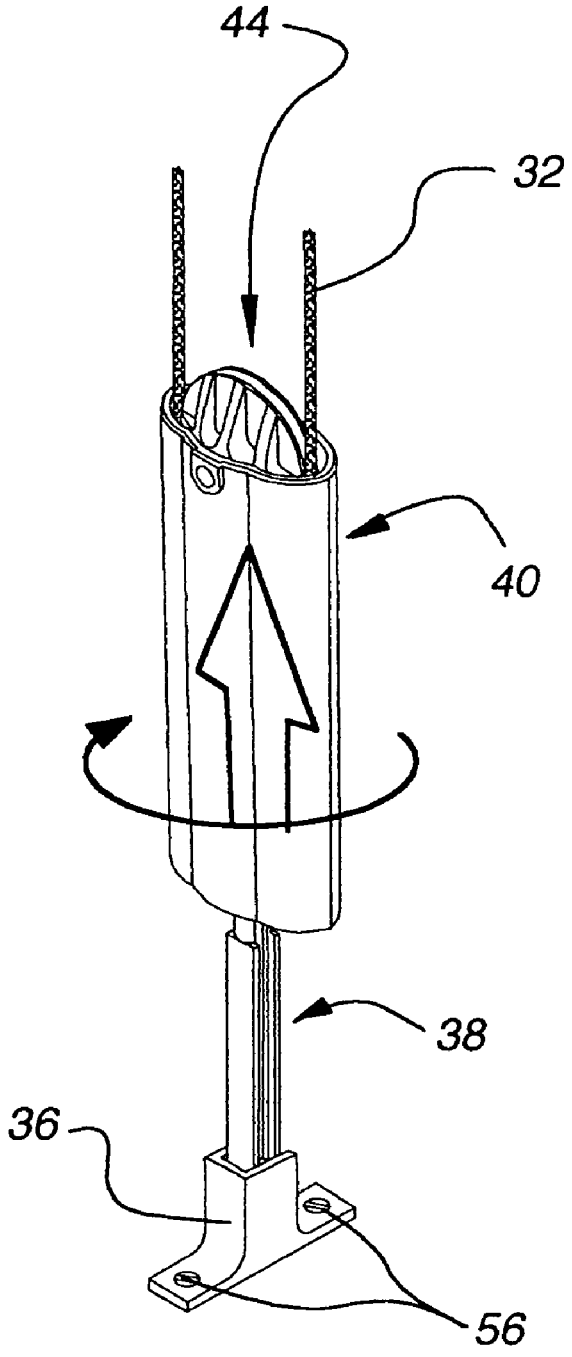
FIG. 14 is an isometric operational view showing the housing in a raised relationship relative to the plunger of the tensioner and in which position the housing is enabled to rotate relative to the plunger.
Figure 15:
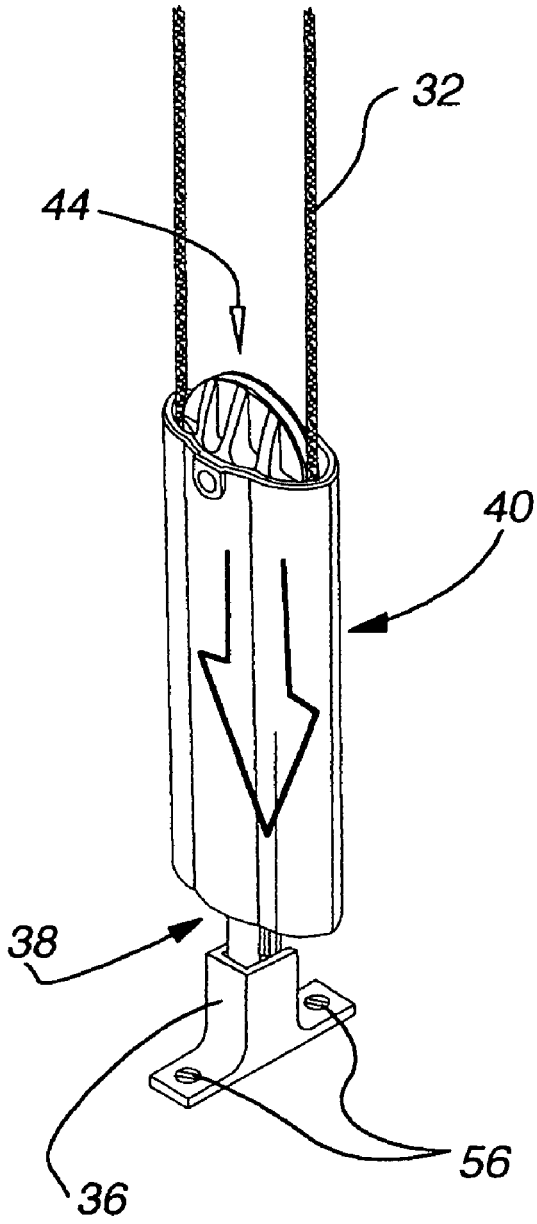
FIG. 15 is an isometric similar to FIG. 14 with the housing in its neutral lowered or rest position relative to the plunger of the tensioner.

With reference to FIGS. 5, 14, and 15, it will further be appreciated that when the housing 40 is fully retracted into its neutral position, as mentioned previously, the housing and consequently the pulley cannot be pivoted or rotated about the longitudinal vertical axis of the plunger 38 because of the mating cross-sectional relationship of the larger lower portion 94 of the shaft of the plunger with the square hole 92 through the bottom wall of the housing. However, if the housing is raised a sufficient distance to the position shown in FIG. 14, the square hole 92 through the bottom wall of the housing becomes horizontally aligned with the smaller cross-sectional upper portion 72 of the shaft of the plunger which, as mentioned previously, is small enough to rotate within the square hole through the bottom wall of the housing.

Accordingly, when the housing 40 is raised to the level illustrated in FIG. 14, it can be rotated about the longitudinal axis of the plunger to a desired angular spacial orientation and when the housing is then allowed to move downwardly under the bias of the spring, the pulley will automatically become aligned due to the beveled top surfaces 112 of the fingers 80 on the head of the plunger in either direction within one or the other of the slots defined in the head of the plunger. Accordingly, the housing can be retained in any one of four angularly related positions which are 90 degrees apart and of course in each of these positions, the larger lower portion 94 of the shaft of the plunger is rotationally confined within the square hole 92 through the bottom wall of the housing to hold the housing in the preset angular position relative to the plunger.

Pursuant to the above, it will be appreciated that a cord tensioner 34 for use in a covering 26 for an architectural opening 20 has been defined which places a desired tension in an endless control element 32 used in such coverings with the tension being established by the coil spring 42. The pulley 44 in the housing 40 around which the lower extent of the endless operating element extends is engaged with a barb 88 in the head 76 of the plunger which prevents rotation of the pulley and thus the control element when the tensioner is in the neutral at-rest position of FIG. 5. The housing is also prevented from rotating about the axis of the plunger 38 in the lower neutral position so that the endless control element can be retained in a desirably aligned relationship for both operation and aesthetic purposes. In other words, the housing can be set so that the control cord does not twist or barber pole along its length but rather the two vertical runs of the control element along its effective length can be maintained in a desirably spaced, straight and parallel relationship for ease of operation and aesthetics. When an operator wants to move the endless control element, a force is applied to the element which includes a lateral component so that the effective vertical length of the endless element is shortened thereby lifting the pulley and the housing to which it is rotatably mounted against the bias of the coil spring and releasing the endless element from its engagement with the barb on the head of the plunger so that it is free to rotate and the covering is free to be operated. Upon completion of operation, however, when an operator releases the endless control element, it automatically assumes its longest effective vertical extent due to the coil spring forcing the housing downwardly thereby pulling the pulley downwardly and the operating element therewith until the pulley is again seated in the head of the plunger and retained in a non-rotating position by the barb on the head of the plunger.

Although the present invention has been described with a certain degree of particularity, it is understood that the disclosure has been made by way of example, and changes in detail or structure may be made without departing from the spirit of the invention as defined in the appended claims.

What is claimed is:

1. A cord tensioner system for anchoring one extent of an endless control cord in a covering for an architectural opening comprising in combination:

a headrail, an endless control element suspended from said headrail, and a tensioning unit including a housing, a pulley rotatably mounted on said housing around which said element extends, an anchor adapted for securement to a frame surrounding said architectural opening, said anchor including a plunger slidably disposed internally of said housing, and a spring positioned within said housing and operatively associated with said plunger and said housing to bias said housing away from said headrail to place tension in said endless element and yieldingly resist movement of said housing toward said headrail.

2. The tensioner of claim 1 wherein said plunger further includes a head on one end thereof having a seat in which said pulley can rest.

3. The tensioner of claim 2 wherein said spring is a compression spring having one end operatively seated against said head and the opposite end engaged with said housing.

4. The tensioner of claim 3 wherein said housing and said plunger include an operative means for selectively preventing pivotal movement of said housing about said plunger.

5. The tensioner of claim 4 wherein said means includes a non-circular hole through said housing and a complementary non-circular cross-sectional configuration of a portion of said plunger.

6. The tensioner of claim 5 wherein said plunger has another portion thereof selectively alignable with said hole and pivotal therein.

7. The tensioner of claim 1 wherein said anchor further includes a base to which said plunger is pivotally attached and wherein said base is adapted to be secured to said frame.

8. The tensioner of claim 5 wherein said housing is a sleeve defining a hollow interior, an open end in which said pulley is mounted and a wall at the opposite end through which said hole extends.

9. A cord tensioner system for anchoring one extent of an endless control cord in a covering for an architectural opening comprising in combination:

a head rail, an endless cord element suspended from said headrail, and a tensioning unit including a housing, a pulley rotatably mounted on said housing around which said element extends, an anchor adapted for securement to a frame surrounding said architectural opening, said anchor including a plunger slidably disposed internally of said housing and a coiled spring positioned within said housing and operatively associated with said plunger and said housing to bias said housing to lift relative to said plunger when any lateral force is applied to said cord.

10. The cord tensioner system of claim 9 wherein the effective length of said cord is shortened by sliding movement of said housing upwardly against said bias of said coil spring.

11. A cord tensioner system for anchoring one extent of an endless control cord in a covering for an architectural opening comprising in combination:

a head rail, an endless control element suspended from said head rail, and a tensioning unit including a housing, a pulley rotatably mounted on said housing around which said element extends, an anchor adapted for securement to a frame surrounding said architectural opening, said anchor including a plunger slidably disposed relative to said housing, and a spring operatively associated with said plunger and said housing to bias said housing away from said head rail to place tension in said endless element and yieldingly resist movement of said housing toward said head rail, said plunger including a head on one end thereof having a seat in which said pulley can rest, said seat including a barb for engagement with said element when the pulley is resting in said seat, and wherein said spring is a compression spring having one end operatively seated against said head and the opposite end engaged with said housing.

12. A cord tensioner system for anchoring one extent of an endless control cord in a covering for an architectural opening comprising in combination:

a head rail, an endless control element suspended from said head rail, and a tensioning unit including a housing, a pulley rotatably mounted on said housing around which said element extends, an anchor adapted for securement to a frame surrounding said architectural opening, said anchor including a plunger slidably disposed relative to said housing, and a spring operatively associated with said plunger and said housing to bias said housing away from said head rail to place tension in said endless element and yieldingly resist movement of said housing toward said head rail, said plunger including a head on one end thereof having a seat in which said pulley can rest and wherein said spring is a compression spring having one end operatively seated against said head and the opposite end engaged with said housing, said housing and said plunger including an operative means for selectively preventing pivotal movement of said housing about said plunger, said means including a noncircular hole through said housing and a complementary non-circular cross-sectional configuration of a portion of said plunger, and wherein said housing is a sleeve defining a hollow interior, an open end in which said pulley is mounted and a wall at the opposite end through which said hole extends, and further wherein said spring is engaged with said wall of the housing.

* * * * *